US005800322A

United States Patent [19]

Block

[11] Patent Number: 5,800,322

[45] Date of Patent: Sep. 1, 1998

[54] EXERCISE DEVICE AND METHOD FOR FORMING HANDLES OF THE DEVICE

[75] Inventor: Steve Block, Deerfield, Ill.

[73] Assignee: Spri Products, Inc., Buffalo Grove, Ill.

[21] Appl. No.: 825,962

[22] Filed: Apr. 4, 1997

Related U.S. Application Data

[63] Continuation of Ser. No. 723,865, Sep. 30, 1996, abandoned.

[51] Int. Cl.[6] ..... A63B 21/02

[52] U.S. Cl. ..... 482/126; 482/139

[58] Field of Search ..... 482/126, 121, 482/122, 124, 139, 82

[56] References Cited

U.S. PATENT DOCUMENTS

| | | | |
|---|---|---|---|
| 2,930,614 | 3/1960 | McIntosh | 482/126 |
| 4,441,707 | 4/1984 | Bosch | 482/139 |
| 4,733,862 | 3/1988 | Miller | 482/126 |
| 4,779,867 | 10/1988 | Hinds | 482/126 |
| 5,062,642 | 11/1991 | Berry et al. | 482/139 |
| 5,131,650 | 7/1992 | Hall | 482/126 |

FOREIGN PATENT DOCUMENTS

| | | | |
|---|---|---|---|
| 9108025 | 6/1991 | WIPO | 482/126 |

OTHER PUBLICATIONS

Photograph of one end of "Product No. 1" (see Information Disclosure Statement).

*Primary Examiner*—Lynne A. Reichard
*Attorney, Agent, or Firm*—Trexler, Bushnell, Giangiorgi & Blackstone, Ltd.

[57] ABSTRACT

An exercise device including an elongated flexible and stretchable tube, a pair of handles, a pair of plugs and a pair of sleeves for securing the handles to respective ends of the elongated tube. The handles each define a hole, and the plugs are received within a channel of the elongated tube adjacent the respective ends of the elongated tube. The plugs prevent the handle from disengaging from the elongated tube. A method is also included for forming each handle, including a method of securing each handle to the elongated tube.

29 Claims, 1 Drawing Sheet

EXERCISE DEVICE AND METHOD FOR FORMING HANDLES OF THE DEVICE

This is a continuation of application Ser. No. 08/723,865, filed Sep. 30, 1996 and now abandoned.

The present invention relates to an exercise device and to a method for forming the handles of the exercise device.

BACKGROUND

Resistance exercise devices compromising a stretchable and flexible elongated tube and a pair of handles secured to respective ends of the elongated tube are known in the art. A user of the device grasps the handle and repeatedly pulls or stretches the elongated tube and then slowly releases the elongated tube to provide resistance exercise and build muscle strength and tone.

A potential problem associated with this device is that it is difficult to eliminate the possibility that the handle will break off from the elongated tube during use of the device. Due to the nature of this type of exercise device, if the handle breaks off during use, it could cause the elongated tube to snap back and possibly cause damage or injury.

Accordingly, it is an object of the present invention to provide an exercise device having a pair of handles that are secured to an elongated tube in a manner that reduces or eliminates the likelihood that either of the handles will break off from the elongated tube during exercise.

It is a further object of the present invention to provide a method for forming such handles, including a method for securing the handles to the elongated tube.

SUMMARY

The present invention in accordance with a preferred embodiment comprises an exercise device including an elongated flexible and stretchable tube having a pair of open ends, a pair of handles, and a pair of flexible sleeves and plugs for securing the handles to the elongated tube adjacent respective ends of the elongated tube. Each handle preferably comprises a strip material defining a hole that receives the elongated tube, and a respective plug is received within a channel defined by the elongated tube and is positioned between the respective end of the elongated tube and the hole. A respective sleeve is disposed about the end of the elongated tube and the plug. Desirably, a grommet is disposed about the hole of each handle, and the grommet hole defined by the respective grommet receives the elongated tube and the sleeve.

The plugs prevent the handles from disengaging from the elongated tube. The plugs desirably have an outer diameter or width that is greater than an inner diameter or width of the elongated tube, an inner diameter or width of the sleeves, and a diameter or width of the grommet holes. As a result, the plugs expand the diameters or widths of respective portions of the flexible elongated tube and the flexible sleeves that surround the plugs, and prevent the respective handles from moving distally of the respective plugs.

By pulling the handles, the user stretches the elongated tube. Since each of the grommets receives one of the sleeves and the elongated tube, the stretching forces are exerted by the grommets as the handles are pulled by the user. Because the sleeves are located between the grommets and the elongated tube, the elongated tube is in direct contact with the sleeves rather than the grommets as the elongated tube is stretched back and forth. Thus, the sleeves protect the elongated tube from direct contact with the grommet, and, as a result, prevent or reduce the likelihood of breakage and extend the life of the exercise device.

In a preferred embodiment, the strip material of each handle has two ends that are joined together in an overlapping relationship to define a loop that is adapted to receive one of the hands (or feet) of a user of the exercise device, and the hole defined in the handle extends through the overlapping area. If desired, a cylindrical grip may be disposed about each handle.

The present invention also includes a method for forming each of the handles of the exercise device, including the method of securing each handle to the elongated tube which comprises the steps of inserting the respective open end of the elongated tube through the hole defined in the respective handle, placing the respective sleeve over the open end of the elongated tube, deforming or expanding the open end of the elongated tube and sleeve to expand a portion of the channel and a portion of a passageway defined by the sleeve, inserting the respective plug into the open end of the elongated tube, and inserting the sleeve into the hole of the handle to engage the sleeve and handle. The method of forming each handle may also include the steps of first inserting one of the ends of the strip material through a respective grip, forming the respective loop from the strip material, forming the hole in the strip material through the overlapping area, and securing or setting the respective grommet about the hole.

The exercise device in accordance with a preferred embodiment is not likely to break off from the elongated tube. As a result, the exercise device is intended to last longer and be safer than the heretofore known exercise devices described above.

The present invention also provides a method of making the exercise device by forming the above-described handles of the exercise device. The method enables each of the handles of the exercise device to be formed readily and easily and in a cost efficient manner. Many of the individual steps of the method can be performed manually.

BRIEF DESCRIPTION OF THE DRAWINGS

The present invention and the advantages thereof will become more apparent upon consideration of the following detailed description when taken in conjunction with the accompanying drawings.

DETAILED DESCRIPTION OF THE PREFERRED EMBODIMENTS

Figure 1:
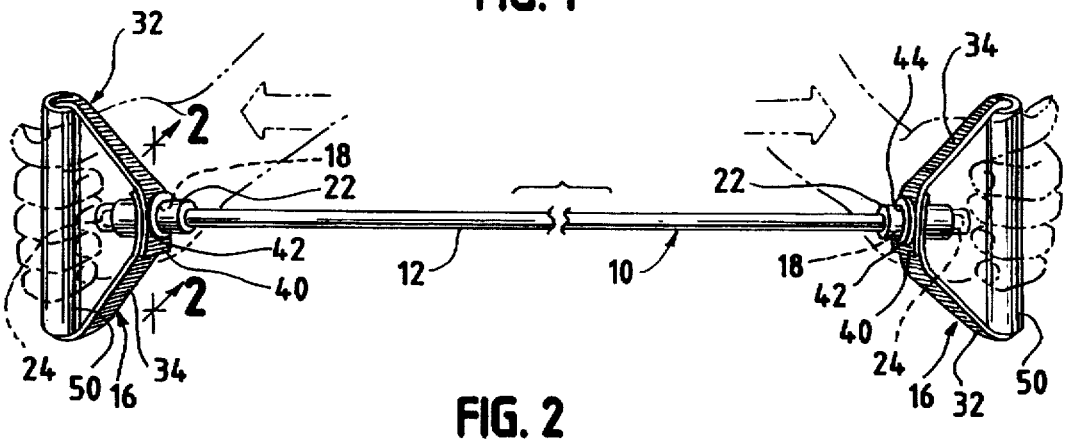
FIG. 1 is a perspective view of an exercise device in accordance with a preferred embodiment of the present invention, illustrating with hands and arrows a manner of use of the device.
Figure 2:
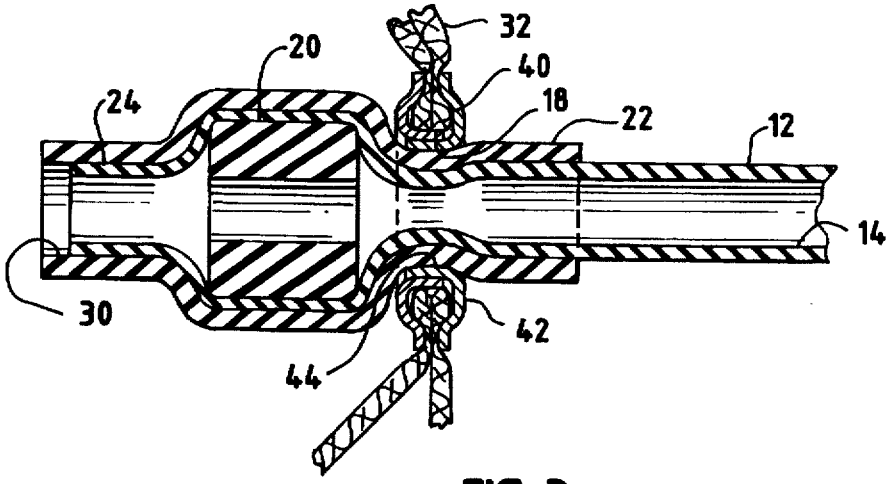
FIG. 2 is a partial transverse view taken along lines 2—2 of FIG. 1, illustrating one of the plugs and one of the sleeves securing one of the handles to the elongated tube.
Figure 3:
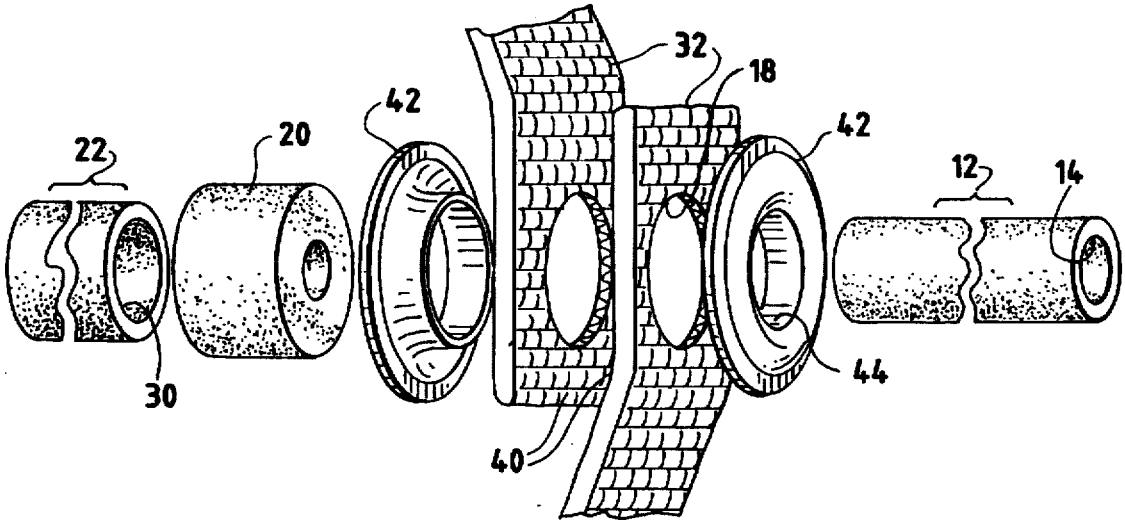
FIG. 3 is a broken view illustrating the plug, sleeve and grommet for securing one of the handles to the elongated tube.

An exercise device 10 in accordance with the embodiment of the invention illustrated in FIGS. 1–3 comprises an elongated flexible and stretchable tube 12 defining a channel 14, a pair of handles 16 defining respective holes 18 receiving the elongated tube, and a pair of plugs 20 and a pair of sleeves 22 for securing the handles to the elongated tube adjacent respective open ends 24 of the elongated tube.

In a preferred embodiment, the channel 14 extends substantially along the length of the elongated tube 12, and the plugs 20 are received within the channel and positioned adjacent the respective open ends 24 of the elongated tube and distal of the holes 18 of respective handles 16. Each sleeve 22 defines a passageway 30 and is disposed about the respective end 24 of the elongated tube 12 and the respective plug 20 extending proximally of the respective end. Each plug 20 is adapted to be received snugly within the elongated tube 12 adjacent the respective open end 24 of the elongated tube and is configured to expand portions of the channel 14 and the respective passageway 30 by deforming or expanding the portions of the elongated tube 12 and sleeve 22 disposed about the plug 20. As a result, each plug prevents the respective handle 16 from disengaging from the tube by preventing the respective handle from moving distally of the plug.

Each handle 16 preferably comprises a webbing or the like in the form of a strip material 32 having two ends which are joined together in an overlapping relationship to define a loop 34 adapted to receive the hand or foot of a user of the exercise device 10 (or, if desired, any suitable structure). The hole 18 defined in the strip material 32 preferably extends through the area of overlap 40. Desirably, the ends of the strip material 32 are fastened together in the area of overlap 40 by a grommet 42 disposed about the hole 18 that defines a grommet hole 44. A washer may be received in the grommet 42. The strip material 32 may be constructed of any suitable material, such as, for example, a polypropylene material.

If desired, a pair of hand grips 50 may also be included. In the illustrated embodiment of the invention, each hand grip 50 is in the form of a cylindrical tube that receives the strip material 32. The hand grip 50 may be constructed of any suitable rigid or flexible plastic or other material. For example, it may be constructed of a high density polyethylene or a flexible PVC.

Each plug 20 may be configured in any manner suitable to expand a respective portion of the channel 14 and a respective portion of the respective sleeve passageway 30. In the illustrated embodiment, the elongated tube 12, plugs 20 and sleeves 22 each have generally cylindrical configurations; and the outer diameter of the plugs 20 is greater than the inner diameter of the elongated tube 12, is greater than the inner diameter of the sleeves, and is greater than the diameter of the grommet hole 44. As a result, when the handles 16 are pulled during use of the exercise device 10, the plugs 20 prevent the handles from disengaging from the elongated tube 12 because the plugs prevent the respective grommets 42 from passing over the respective plugs and thus limit the movement of the respective handles 16 in the respective distal directions.

Additionally, when the handles 16 are pulled by the user, the pulling forces of the handles are exerted onto the elongated tube 12 by grommets 42, which pull the elongated tube in opposite directions and stretch the elongated tube. Since the sleeves 22 are located between the grommets 42 and the elongated tube 12, the sleeves protect the elongated tube from direct contact with the grommet. Thus, as the elongated tube 12 is stretched back and forth, the elongated tube rubs against the sleeves 22 rather than the grommet 42. As a result, the sleeves 22 prevent or reduce the likelihood of breakage and extend the life of the elongated tube 12.

In a preferred embodiment, the inner diameter of the sleeve 22 desirably is slightly less than or substantially equal to the outer diameter of the elongated tube 12. Additionally, the outer diameter of the sleeve 22 is slightly less than or substantially equal to the grommet hole 44 so that the handle 16 can engage the sleeve.

The elongated tube 12, plugs 20 and sleeves 22 may be constructed of any suitable material, such as rubber or the like. Preferably, the elongated tube 12 and sleeves 22 are constructed of the same material, which, because the elongated tube 12 rubs against the sleeves 22 as it is stretched back and forth, tends to extend the life of the elongated tube. Similarly, it is also desirable for the plugs 20 to be constructed of the same material. Preferably, the plug 20 is substantially thicker than the elongated tube 12 and sleeve 22 to provide increased rigidity.

In a preferred embodiment, each handle 16 of the exercise device 10 is formed by a method that includes the steps of inserting one of the ends of the strip material 32 through one of the grips 50, joining the two ends of the strip material in an overlapping relationship to form the loop 34, forming the hole 18 in the strip material in the area of overlap 40, setting or securing one of the grommets 42 on the strip material about the hole 18, inserting one of the ends 24 of the elongated tube 12 through the grommet hole 44, placing one of the sleeves 22 over the end 24 of the elongated tube, expanding a portion of the elongated tube channel 14 and the sleeve passageway 30 by deforming the open ends of the elongated tube and sleeve, inserting one of the plugs 20 into the end of the tube and positioning the plug distal of the grommet hole, and inserting the sleeve 22 into the grommet hole 44 of the handle 16 to engage the sleeve. The above steps can be repeated to form the other handle 16.

The above steps can be accomplished in any suitable manner. If desired, many of these steps can be accomplished manually, including, for example, the steps of inserting one of the ends of the strip material 32 through one of the grips 50, joining the two ends of the strip material in an overlapping relationship to form the loop 34, inserting the end 24 of the elongated tube 12 through the grommet hole 44, placing the sleeve 22 over the end of the tube, inserting the plug 20 into the channel 14 of the tube and the passageway 30 of the sleeve, and inserting the sleeve 22 into the grommet hole 44 to engage the handle. The step of joining the two ends of the strip material together to form a loop may include stitching the material together.

The step of forming the hole 18 in the strip material 32 can be accomplished in any suitable manner, such as, for example, by manual application of a soldering iron. The step of setting the grommet 42 may be accomplished by any suitable means such as, for example, by any suitable grommet setting device. The step of forming the hole or of setting the grommet also may secure the two ends of the strip material together.

The step of expanding the portions of the elongated tube channel 14 and sleeve passageway 30 by deforming or expanding the open ends of the elongated tube 12 and sleeve 22 also can be accomplished in any suitable manner. For example, it can be accomplished mechanically by inserting a plurality of pins or the like into the channel 14 at the open end 24 of the elongated tube 12. The spacing between the pins is mechanically increased and the plug 20 then can be manually inserted into the channel 14. The spacing between the pins is then mechanically decreased, and the pins are removed from the channel 14. This step of deforming or expanding the ends 24 of the elongated tube 12 and the sleeve 22 can be accomplished pneumatically or by any other suitable machine.

The various components can have any suitable dimensions. For example, each strip material 32 may have a length of about 15 inches and a width of about 1 or 1.5 inches. Each grip 50 may have an inside diameter of about 0.60 inches, an outside diameter of about 0.75 inches, and a length of about 4.5 inches. The elongated tube 12 (in its unstretched state) may have an inside diameter in the range of about 0.25 to 0.625 inches, an outer diameter of about 0.375 inches, and a length of about 3.5 to 4 feet. Each sleeve 22 (in its unstretched stated) may have an inner diameter of about 0.37 inches, an outer diameter of about 0.50 inches, and a length of about 2 inches. Each plug 20 may have an inner diameter of about 0.24 inches, an outer diameter of about 0.60 inches and a length of about 0.50 inches. Each grommet hole 44 may have a diameter in the range of about 0.187 to 0.625 inches, and the area of overlap 40 of the strip material 32 may have a length of about 1 inch.

The foregoing description is for purposes of illustration only and is not intended to limit the scope of the protection accorded this invention. The scope of protection is to be measured by the following claims which should be interpreted as broadly as the inventive contribution permits.

The invention claimed is:

1. An exercise device comprising:

(a) an elongated flexible tube defining a channel and having at least one end;

(b) a handle defining a hole receiving the elongated tube;

(c) at least one plug received within the channel distal of the hole and expanding a portion of the channel, the plug adapted to prevent the handle from moving distally of the plug; and (d) a sleeve defining a passageway, the sleeve being disposed about a portion of the elongated tube that surrounds said portion of the channel and extending through the hole to engage the handle.

2. The exercise device of claim 1 wherein the sleeve is flexible and the plug also expands a portion of the passageway.

3. The exercise device of claim 2 wherein the handle comprises a loop.

4. The exercise device of claim 3 wherein the handle is comprised of a strip material having two ends joined together in overlapping relation to define an area of overlap, the hole extending through the area of overlap.

5. The exercise device of claim 2 wherein the elongated tube has an inner diameter substantially along the length of an unexpanded portion of the channel and the plug has an outer diameter greater than said inner diameter of the elongated tube.

6. The exercise device of claim 2 wherein the sleeve has an inner diameter substantially along the length of an unexpanded portion of the passageway and the plug has an outer diameter greater than said inner diameter of the sleeve.

7. The exercise device of claim 2 wherein the hole has a diameter and the plug has an outer diameter greater than the diameter of the hole.

8. The exercise device of claim 2 further including a grommet disposed about the hole defining a grommet hole having a diameter, the plug having an outer diameter greater than the diameter of the grommet hole.

9. The exercise device of claim 2 wherein the plug is a cylindrical element.

10. The exercise device of claim 2 wherein the elongated tube includes a first cylindrical wall having a thickness that defines the channel and the plug includes a second cylindrical wall having a thickness, the thickness of the second cylindrical wall being greater than the thickness of the first cylindrical wall.

11. The exercise device of claim 2 wherein the elongated tube and flexible sleeve are constructed of the same material.

12. The exercise device of claim 2 further including a grip joined to the handle.

13. The exercise device of claim 12 wherein the grip is an elongated cylindrical element disposed about the handle.

14. The exercise device of claim 2 wherein the channel extends substantially along the length of the elongated tube.

15. The exercise device of claim 2 wherein the elongated tube has an other end and further comprising:

(a) an other handle defining a hole receiving the elongated tube;

(b) an other plug received within the channel distal of the hole of the other handle expanding an other portion of the channel, the other plug adapted to prevent the other handle from moving distally of the other plug; and (c) an other flexible sleeve defining a passageway, the other sleeve being disposed about a portion of the elongated tube disposed about the other expanded portion of the channel and extending through the hole of the other handle to engage the other handle, the other plug expanding a portion of the passageway of the other sleeve.

16. A method for making an exercise device by securing at least one handle to an elongated flexible tube defining a channel, the method including the steps of:

(a) inserting an open end of the elongated tube through a hole defined by the handle;

(b) placing over the open end of the elongated tube a flexible sleeve defining a passageway;

(c) expanding the channel at the open end of the elongated tube to define an expanded portion of the channel distal of the hole and expanding the passageway at an open end of the sleeve to define an expanded portion of the passageway disposed about the expanded portion of the channel; and (d) inserting a plug into the expanded portion of the channel.

17. The method of claim 16 further including the step of inserting the sleeve into the hole to engage the sleeve and handle.

18. The method of claim 16 further including the step of securing a grommet to the handle about the hole.

19. The method of claim 16 wherein the handle is comprised of a strip material having a pair of ends and further including the step of forming a loop from the strip material.

20. The method of claim 19 wherein the loop-forming step includes joining the two ends of the strip material in overlapping relationship to define an area of overlap, the hole extending through the area of overlap.

21. The method of claim 16 wherein an other handle is secured to the elongated tube, the method further including the steps of:

(e) inserting an other open end of the elongated tube through a hole of the other handle;

(f) placing over the other open end of the elongated tube an other flexible sleeve defining a passageway;

(g) expanding the channel at the other open end of the elongated tube to define another expanded portion of the channel distal of the hole of the other handle and expanding the passageway of the other sleeve at an open end of the other sleeve to define an expanded passageway of the other sleeve disposed about the other expanded portion of the channel; and (h) inserting an other plug into the other expanded portion of the channel.

22. The method of claim 21 further including the step of securing another grommet to the other handle about the hole of the other handle.

23. A method of forming at least one handle of an exercise device comprising an elongated tube defining a channel, the method comprising the steps of:

(a) forming a loop from a strip material having two ends;

(b) forming a hole in the strip material;

(c) inserting an open end of the elongated tube through the hole;

(d) placing a flexible sleeve over the open end of the elongated tube, the sleeve defining a passageway;

(e) expanding the channel at the open end of the elongated tube to define an expanded portion of the channel extending into the elongated tube and expanding the passageway at an open end of the sleeve to define an expanded portion of the passageway extending into the passageway;

(f) inserting a plug into the expanded channel and positioning the plug distal of the hole; and (g) inserting the sleeve into the hole to engage the sleeve and strip material.

24. The method of claim 23 wherein during step (a) the two ends of the strip material are joined together in an overlapping relationship to define an area of overlap and wherein during step (b) the hole is formed through the area of overlap.

25. The method of claim 23 further including the step of securing a grommet to the hole.

26. The method of claim 23 further including the step of inserting one end of the strip material through a substantially cylindrical grip before step (a).

27. The method of claim 23 wherein an other handle is formed on the exercise device, the method further including the steps of:

(h) forming an other loop from an other strip material having two ends;

(i) forming a hole in the other strip material;

(j) inserting an other open end of the elongated tube through the hole in the other strip material;

(k) placing an other flexible sleeve over the other open end of the elongated tube, the other sleeve defining a passageway;

(l) expanding the channel at the other open end of the elongated tube to define an other expanded portion of the channel extending into the elongated tube and expanding the passageway at an open end of the other sleeve to define an expanded portion of the passageway of the other sleeve extending into the passageway of the other sleeve;

(m) inserting an other plug into the other expanded channel and positioning the other plug distal of the hole of the other handle; and (n) inserting the other sleeve into the hole of the other handle to engage the other sleeve and the other strip material.

28. The method of claim 27 wherein during step (h) the two ends of the other strip material are joined together in an overlapping relationship to define an area of overlap and wherein during step (i) the hole of the other strip material is formed through the area of overlap of the other strip material.

29. The method of claim 27 further including the step of inserting one end of the other strip material through an other substantially cylindrical grip before step (h).

* * * * *